US006568789B2

(12) United States Patent
Lin et al.

(10) Patent No.: US 6,568,789 B2
(45) Date of Patent: May 27, 2003

(54) PRINT HEAD MAINTENANCE DEVICE USED IN A PRINTING DEVICE

(75) Inventors: Tsung-Te Lin, San-Chung (TW); Ying-Hsien Kuo, Taipei (TW)

(73) Assignee: Acer Communications and Multimedia Inc., Taipei (TW)

( * ) Notice: Subject to any disclaimer, the term of this patent is extended or adjusted under 35 U.S.C. 154(b) by 57 days.

(21) Appl. No.: 09/836,212

(22) Filed: Apr. 18, 2001

(65) Prior Publication Data

US 2001/0035891 A1 Nov. 1, 2001

(30) Foreign Application Priority Data

Apr. 28, 2000 (TW) ..... 89108116 A

(51) Int. Cl.[7] ..... B41J 2/165

(52) U.S. Cl. ..... 347/33; 347/22; 347/23; 347/24; 347/25; 347/26; 347/27; 347/28; 347/29; 347/30; 347/31; 347/32; 347/33; 347/34

(58) Field of Search ..... 347/22–34

(56) References Cited

U.S. PATENT DOCUMENTS 5,027,134 A * 6/1991 Harmon et al. ..... 347/29
5,621,441 A 4/1997 Waschhauser et al.
5,689,293 A 11/1997 Hirano
5,847,728 A 12/1998 Lee
5,898,445 A 4/1999 Becker et al.
5,946,009 A 8/1999 Youn
6,398,340 B1 * 6/2002 Lin ..... 347/33

FOREIGN PATENT DOCUMENTS

EP 604068 * 6/1994
JP 06328705 A 11/1994

* cited by examiner

*Primary Examiner*—Hai Pham
*Assistant Examiner*—Ly T Tran
(74) *Attorney, Agent, or Firm*—Winston Hsu

(57) ABSTRACT

A print head maintenance device is used in a printing device. The print head maintenance device cleans a print head of the printing device. The print head is movable on a horizontal track of the printing device. The print head has at least one linearly arranged nozzle array. When the print head moves across the maintenance device, the print head will connect with the maintenance device through the connecting device, making the connecting device capable of moving along the first track to slide the ink brush along the second track so as to clean remaining ink from the nozzle array of the print head.

11 Claims, 13 Drawing Sheets

PRINT HEAD MAINTENANCE DEVICE USED IN A PRINTING DEVICE

BACKGROUND OF THE INVENTION

1. Field of the Invention

The present invention relates to a maintenance device, and more particularly, to a print head maintenance device used in a printing device.

2. Description of the Prior Art

Nowadays machines often used in document processing include photostats, faxes, and printers. To meet the requirement of high quality printing, the common ink jet printer mostly requires a print head maintenance device to clean and maintain a print head so as to avoid ink contamination.

A general print head maintenance device comprises a wiper, a print head cap, and a blotting device. The wiper is used to wipe remaining ink from the print head. The print head cap is used to cap the print head to avoid remaining ink drying on the print head blocking the nozzles when the print head returns to its original position. The blotting device is used to absorb ink jetted by the print head when cleaning the nozzles.

As mentioned, the print head and the wiper must have relative motions, so the objective of wiping ink can be achieved. In a prior art print head maintenance device, according to different arrangements of nozzle array on the print head, the relative motions of the print head and the wiper can be divided into two arrangements. If a plurality of chromatic nozzle arrays on the print head uses an arrangement perpendicular to the horizontal, the direction of the relative motions of the print head and the wiper can be in parallel. Nevertheless, if the plurality of chromatic nozzle arrays on the print head uses an arrangement parallel to the horizontal, a direction of the relative motions of the print head and the wiper must be perpendicular to each other so as to prevent chromatic ink contamination during wiping.

For the above mentioned first condition, the direction of the relative motions of the print head and the wiper can optically fix one party and move the other to produce a parallel movement. For example, the simplest solution is to fix the print head at a predetermined position in the process to achieve the objective of wiping ink. For the second condition, a direction of the relative motions of the print head and the wiper is produced by moving the wiper in a direction perpendicular to the movement of the print head after the print head reaches a predetermined position on the process to achieve the objective of wiping ink and prevent chromatic ink contamination. This movement of the wiper usually employs an extra motor.

Currently, the arrangement of the plurality chromatic nozzle arrays on the print head often uses a side-by-side arrangement. Therefore, the direction of the relative motions of the print head and the wiper must be exactly perpendicular to wipe remaining ink from the print head. But in the prior art, to achieve the relative motions, a motor is added in the maintenance device to drive the wiper, thus the cost of the maintenance device is increased.

SUMMARY OF THE INVENTION

It is therefore a primary objective of the present invention to provide a print head maintenance device to solve the above mentioned problems.

According to the claimed invention, the print head maintenance device is used to clean a print head of a printing device. The print head is movable on a horizontal track of the printing device. The print head has at least one linearly arranged nozzle array. The maintenance device comprises a line-shaped first track in parallel with the horizontal track, a line-shaped second track having a first section which forms a slant angle with the first track and a second section which is in parallel with the first track, an ink brush slidably installed on the second track for cleaning remaining ink from the nozzle array of the print head, and a connecting device moveable along the first track in the maintenance device. When the print head moves across the maintenance device, the print head will connect with the maintenance device through the connecting device. The connecting device can move along the first track to slide the ink brush along the second track to clean remaining ink from the nozzle array of the print head.

It is an advantage of the present invention that the wiping direction of the ink brush of the maintenance device is perpendicular to the movement direction of the print head. Besides, there is no need to install another motor to drive the ink brush so reducing the cost of the maintenance device.

These and other objectives and advantages of the present invention will no doubt become obvious to those of ordinary skill in the art after having read the following detailed description of the preferred embodiment that is illustrated in the various figures and drawings.

Figure 1:
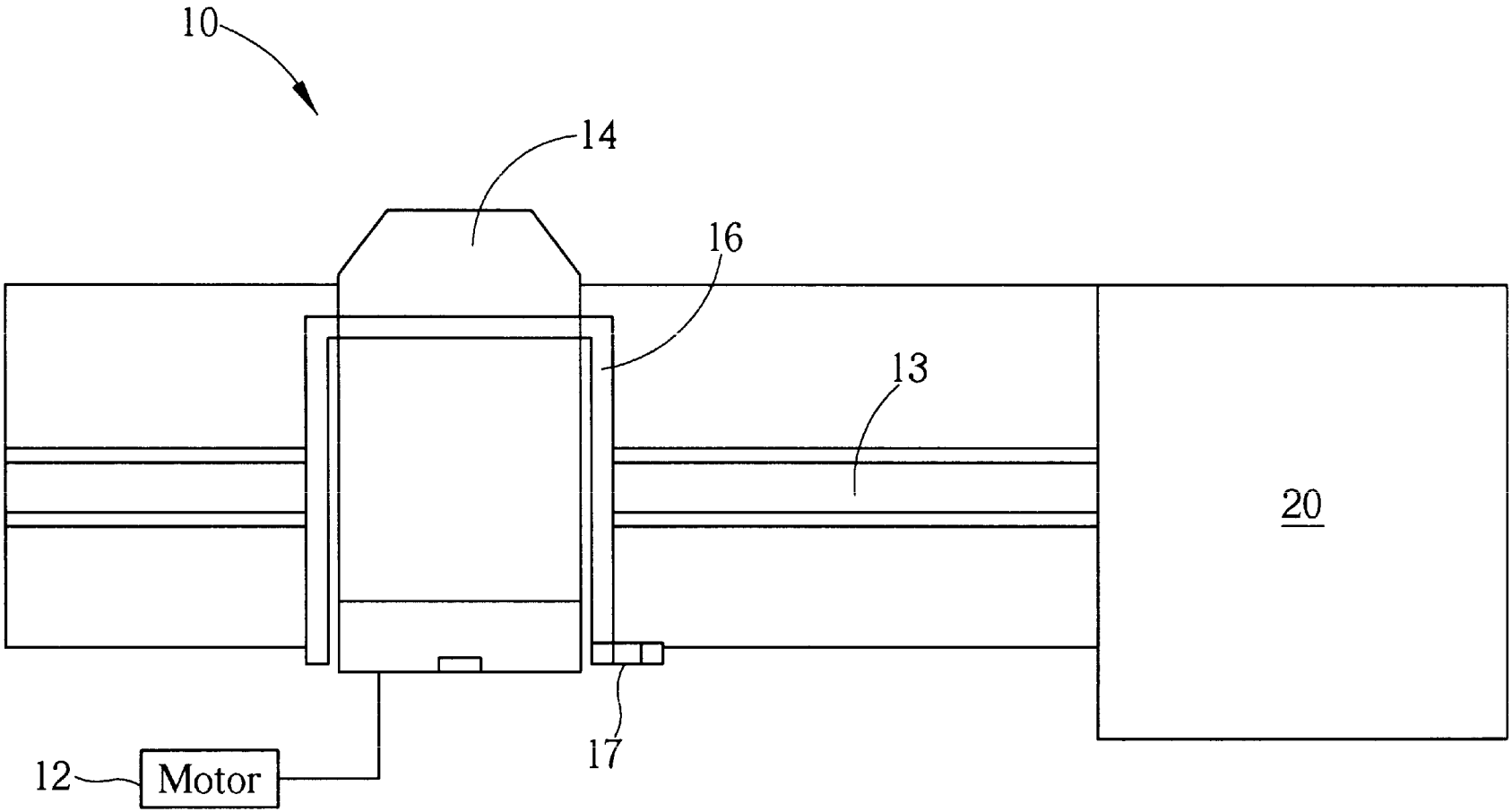
FIG. 1 is a diagram of a printing device of the present invention.

DETAILED DESCRIPTION OF THE PREFERRED EMBODIMENT please refer to FIG. 1 of a diagram of a printing device 10 of the present invention. The present invention provides a print head maintenance device 20. The maintenance device 20 is used to clean a print head of a printing device 10. The printing device 10 comprises a motor 12 for supplying power, a print head 14, a carrier 16 for carrying the print head 14 and performing a movement, and a horizontal track 13, as shown in FIG. 1. When the printing device 10 starts to perform a printing operation, the motor 12 will drive the print head 14 to move back and forth along the linear horizontal track 13. Three at aside of the print head 14 (as shown in FIG. 13B) for spraying linearly arranged and parallel nozzle arrays 15 are installed ink with three different colors, such as cyan, magenta, and yellow. The arrangement direction of the three nozzle arrays 15 in parallel is perpendicular to the horizontal track 13.

Figure 2:
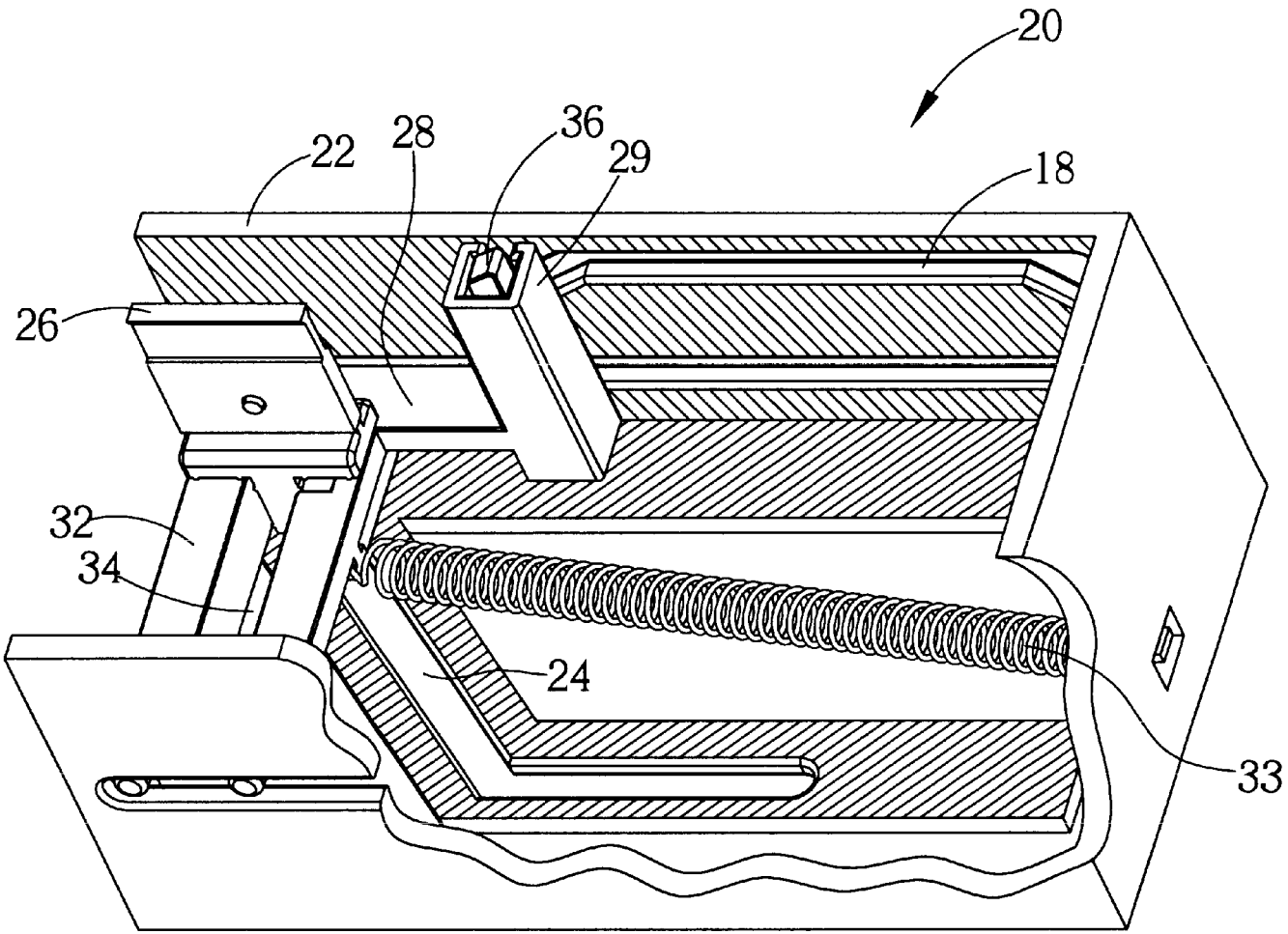
FIG. 2 is a diagram of a print head maintenance device shown in FIG. 1.

Please refer to FIG. 2 of a diagram of the present invention print head maintenance device 20. The maintenance device 20 comprises a housing 22, a first track 18, a second track 24, an ink brush 26, and a connecting device 28. The first track 18 is in parallel with the horizontal track 13. The second track 24 is installed at the bottom of the housing 22, and divides into a first section and a second section. The first section forms a slant angle with the first track 18, and the second section is in parallel with the first track 18. The ink brush 26 is slidably installed on the second track 24 for cleaning remaining ink from the nozzle array 15 of the print head 14. The connecting device 28 is moveable along the first track 18 in the maintenance device 20 and comprises a connecting end 29 and a driving end 32. The connecting end 29 of the connecting device 28 has a plug 36, and the driving end 32 has a linear slot 34. The maintenance device 20 further comprises an elastic device 33 connected between the driving end 32 and the housing 22 of the connecting device 28 for pulling the connecting device 28 to a side of the housing 22.

Figure 3:
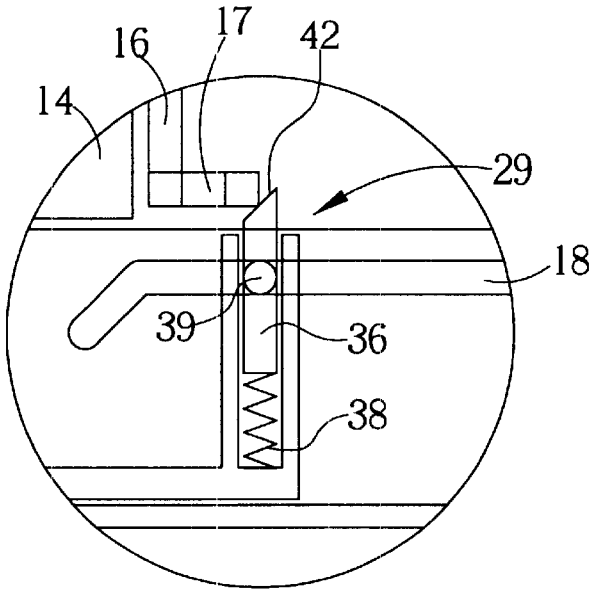
FIG. 3 to FIG. 8 are diagrams of partial operations of a print head and a connecting device shown in FIG. 1 and FIG. 2.
Figure 4:
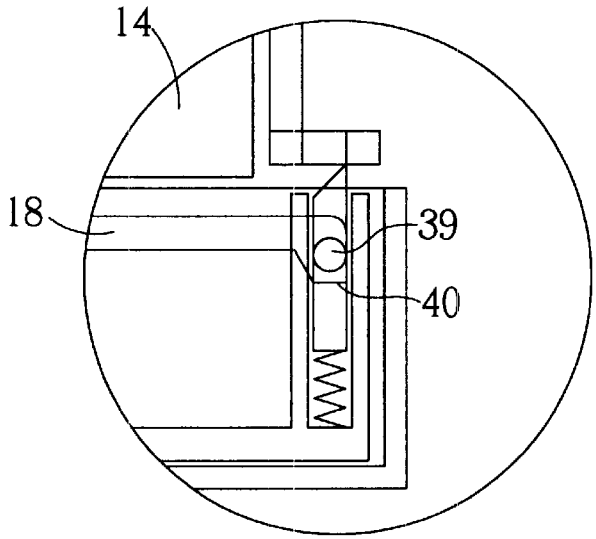
Figure 5:
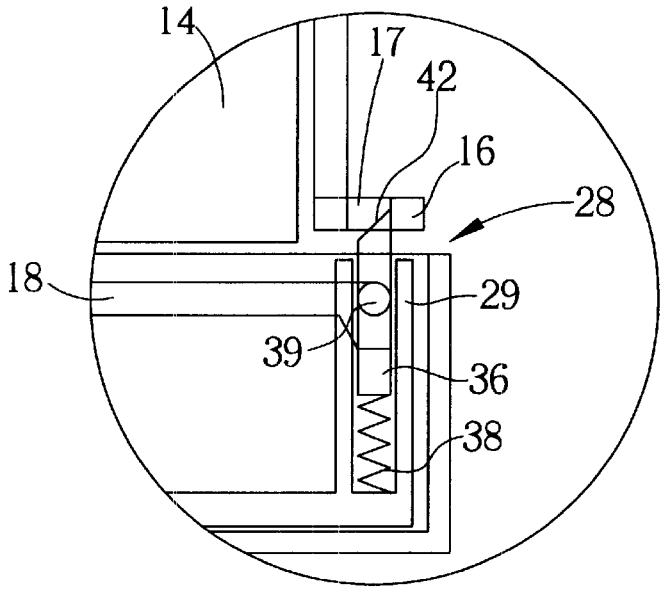
Figure 6:
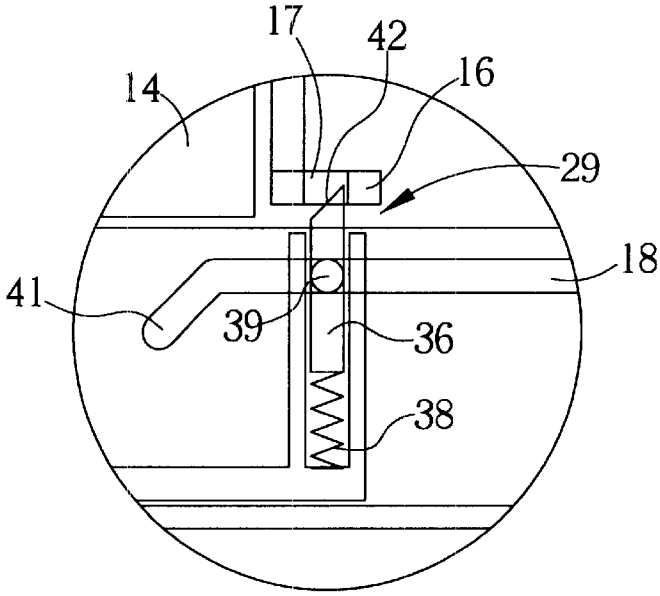
Figure 7:
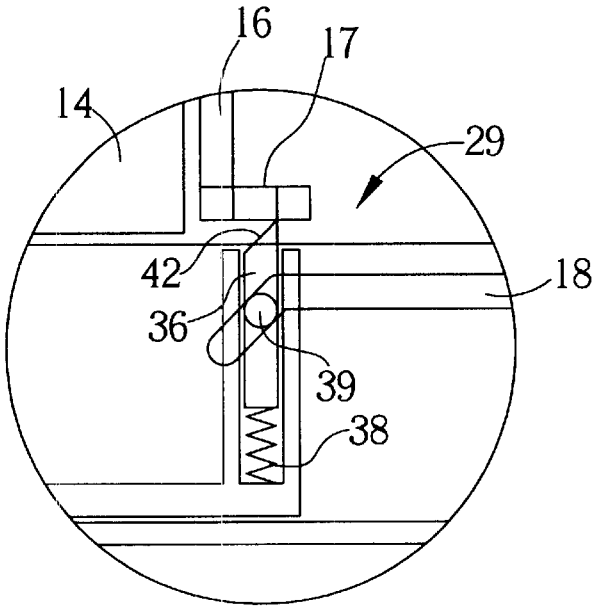
Figure 8:
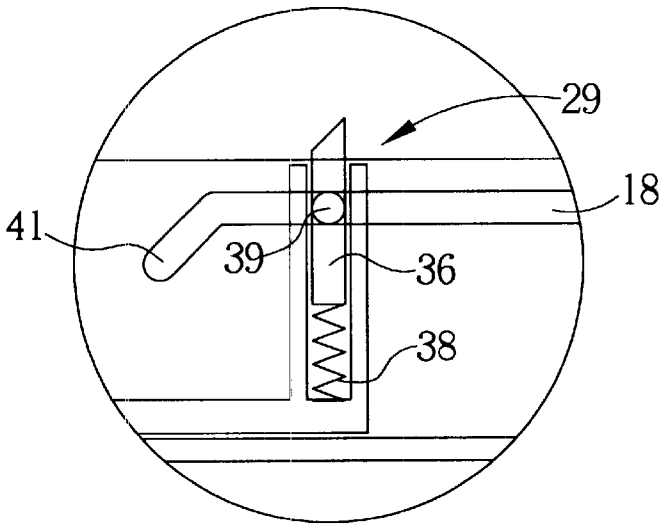

Please refer to FIG. 3 to FIG. 8. FIG. 3 to FIG. 8 are diagrams of partial operations of the present invention print head 14 and the connecting device 28. A top of the plug 36 of the connecting device 28 comprises a guiding incline 42, and a bottom of the plug 36 of the connecting device 28 comprises a spring 38 for elastically supporting the plug 36 upward. A side of the plug 36 has a protruding shaft 39 passing through the first track 18 so that the plug 36 and the first track 18 can keep in relative positions. A bottom of the carrier 16 of the printing device 10 has a receiving slot 17 for receiving the plug 36. As shown in FIG. 3, when the carrier 16 brings the print head 14 to move to the maintenance device 20 along the horizontal track 13, the carrier 16 will ram against the guiding incline 42 of the plug 36 first, then push the first track 18 to a descended end 40 of the first track 18 to cause the plug 36 (as shown in FIG. 4) to insert into the receiving slot 17 of the carrier 16 (as shown in FIG. 5) so that the carrier 16 and the connecting device 28 form a monolithic. After completing the connecting steps of the carrier 16 and the connecting device 28, the print head 14 and the connecting device 28 move to the starting end 41 of the first track 18 along the first track 18 together (as shown in FIG. 6). When the print head 14 wants to leave the maintenance device 20, the print head 14 will bring the plug 36 into a descended starting end 41 of the first track 18 (as shown in FIG. 7) so that the plug 36 can disengage from the receiving slot 17 at the bottom of the carrier 16 completely. When the plug 36 disengages from the receiving slot 17 of the bottom of the carrier 16, the elastic device 33 will pull the connecting device 28 to a side of the housing 22 so that the plug 36 leaves the starting end 41 of the first track 18 (as shown in FIG. 8).

The linear direction of the linear slot 34 of the connecting device 28 is in parallel with the arrangement of the nozzle array 15 of the print head 14, and the bottom of the ink brush 26 is perpendicularly installed on the second track 24 of the bottom of the housing 22 through the linear slot 34 of the connecting device 28. When the driving end 32 of the connecting device 28 pushes the ink brush 26 along the direction of the first track 18, the ink brush 26 will move along the second track 24 and the linear slot 34 of the connecting device 28 simultaneously.

Figure 9:
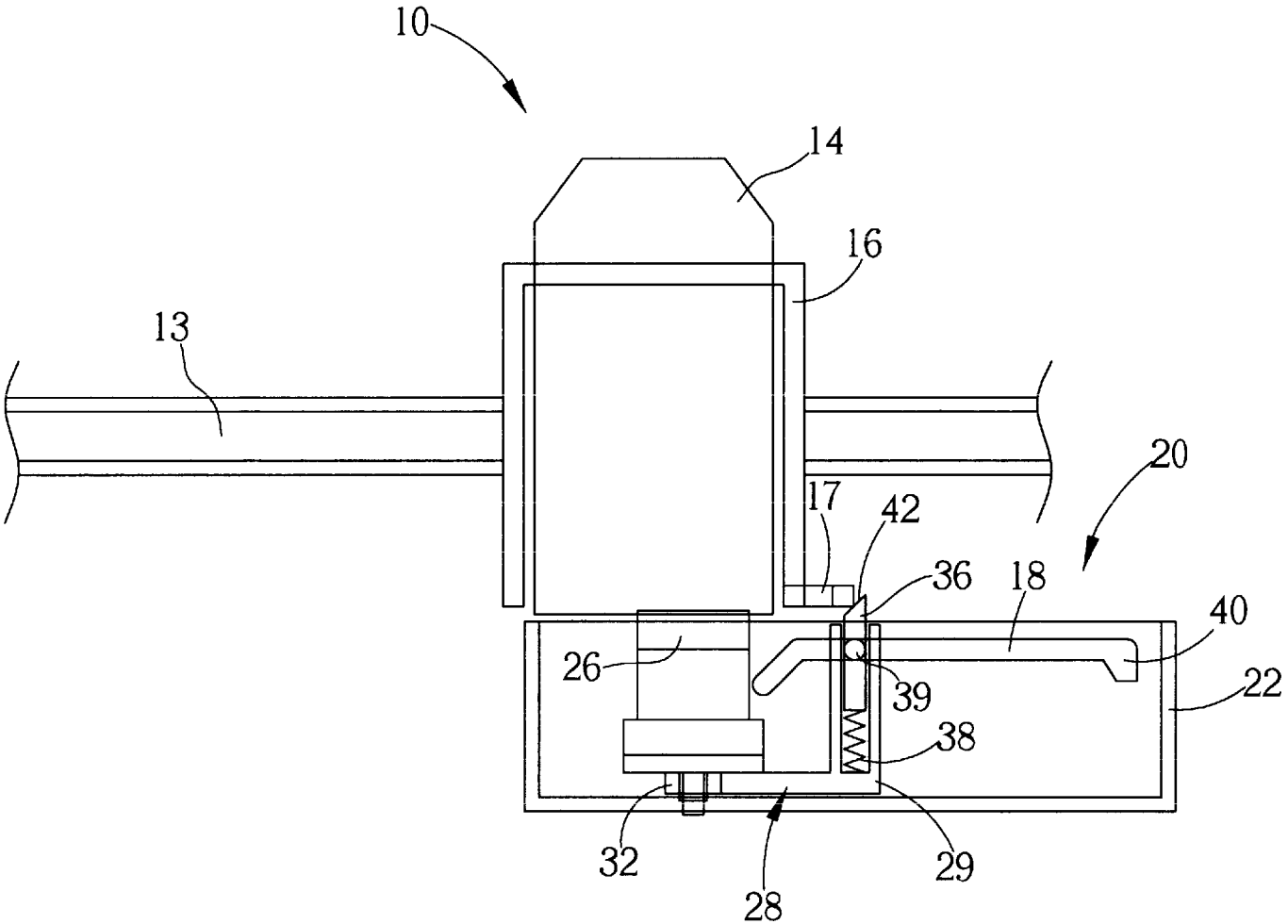
FIG. 9 to FIG. 13 are diagrams of continuous operations of a relative movement between the print head and the maintenance device shown in FIG. 1.
Figure 10:
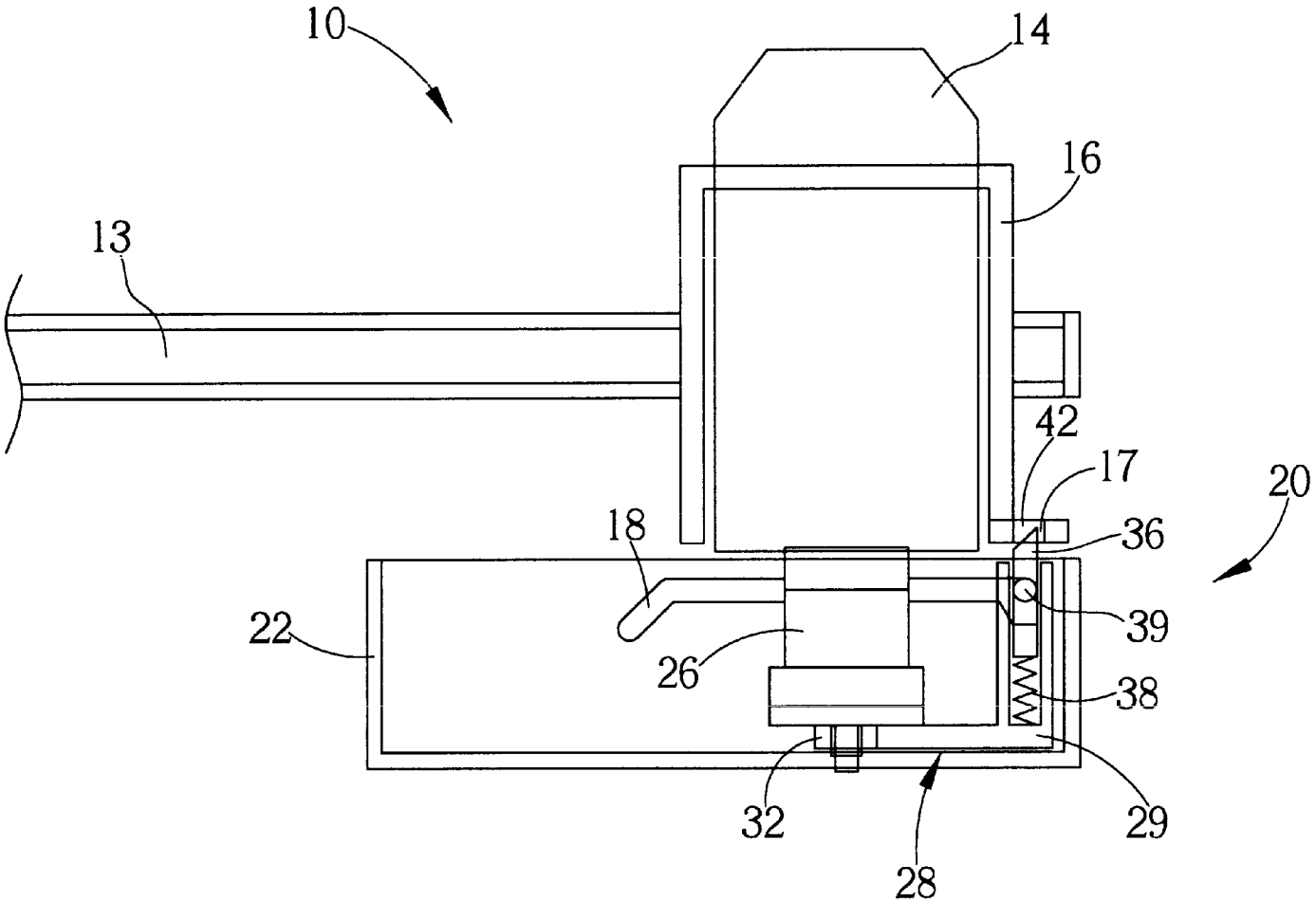
Figure 11:
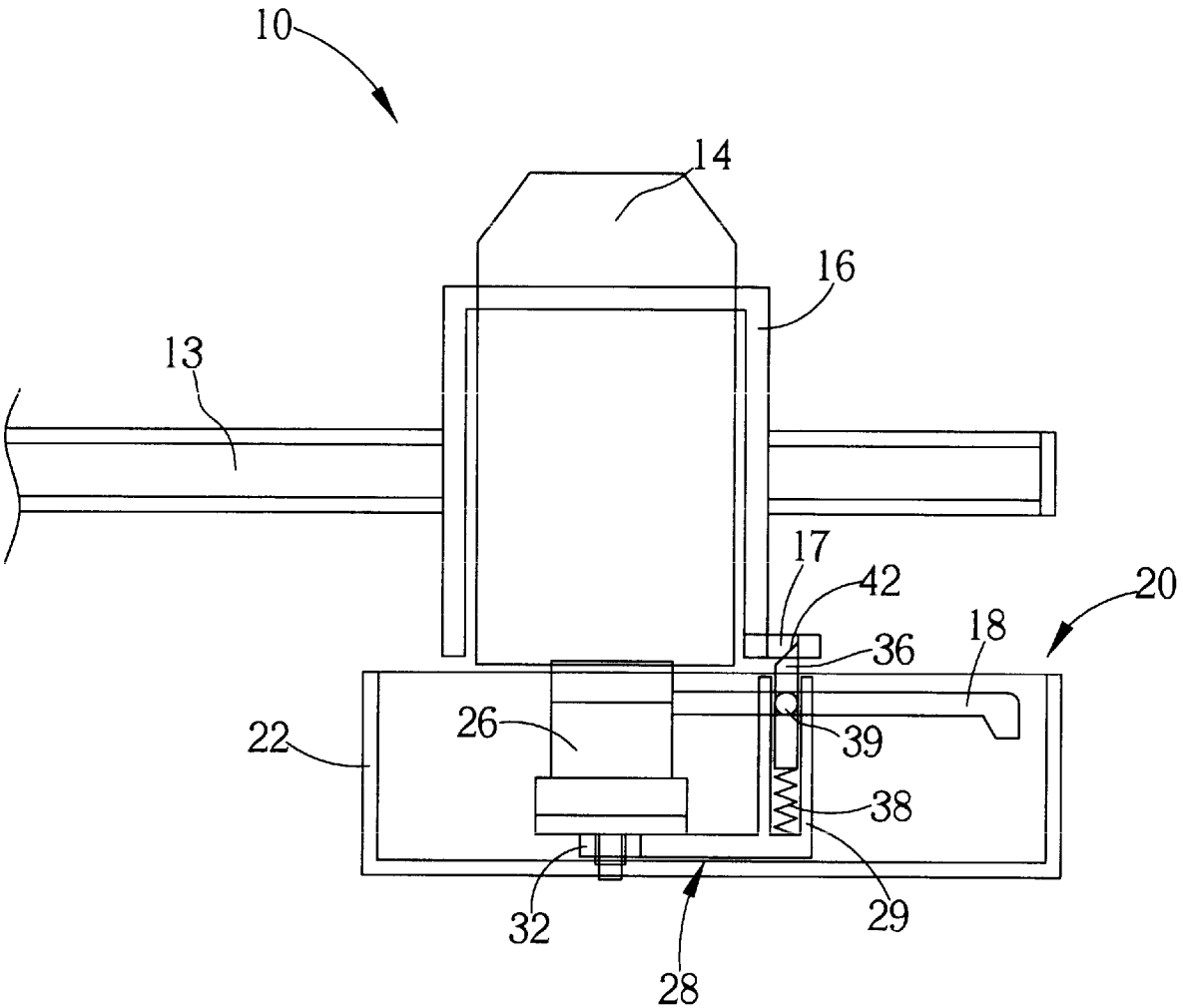
Figure 12:
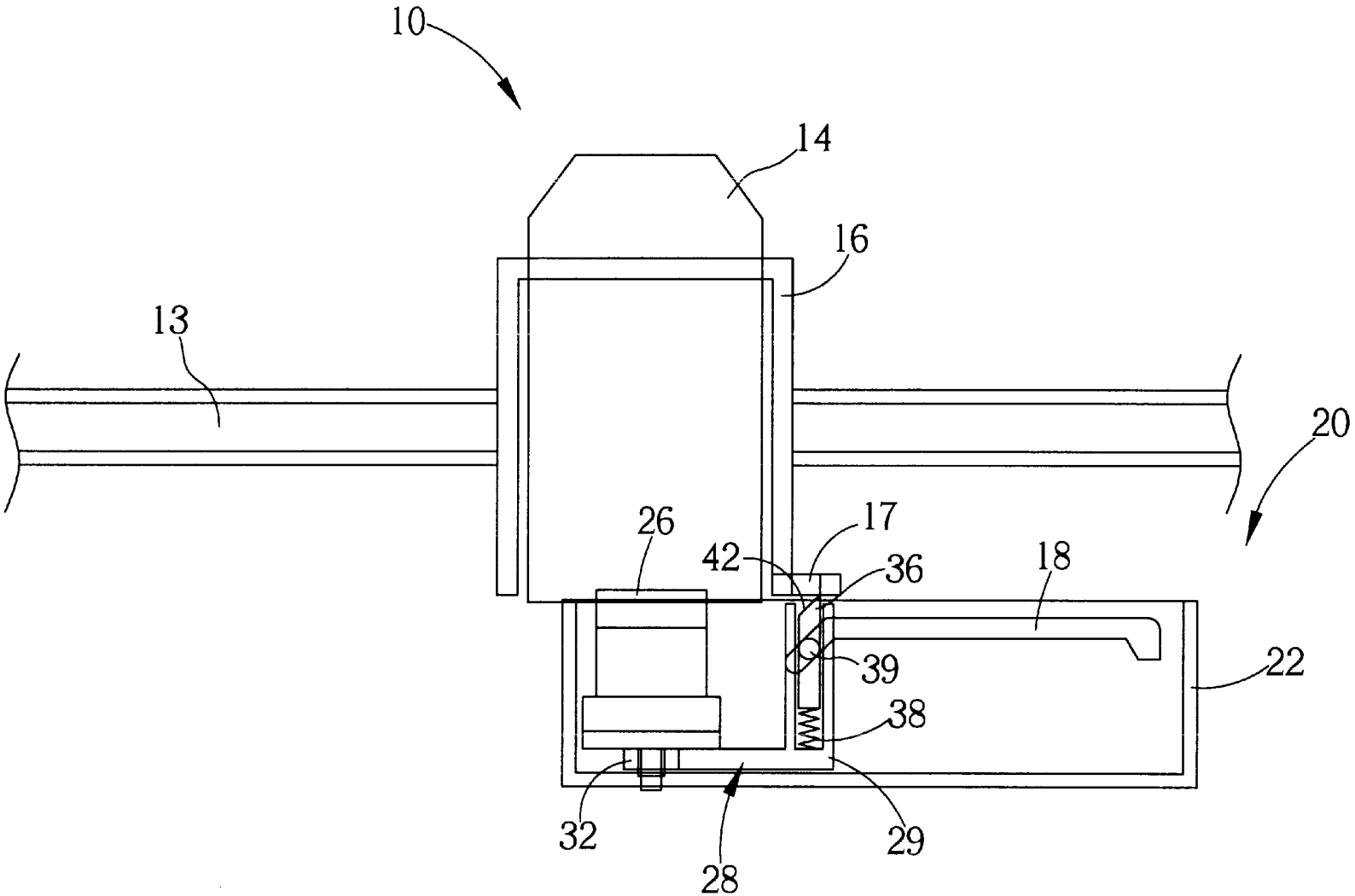
Figure 13:
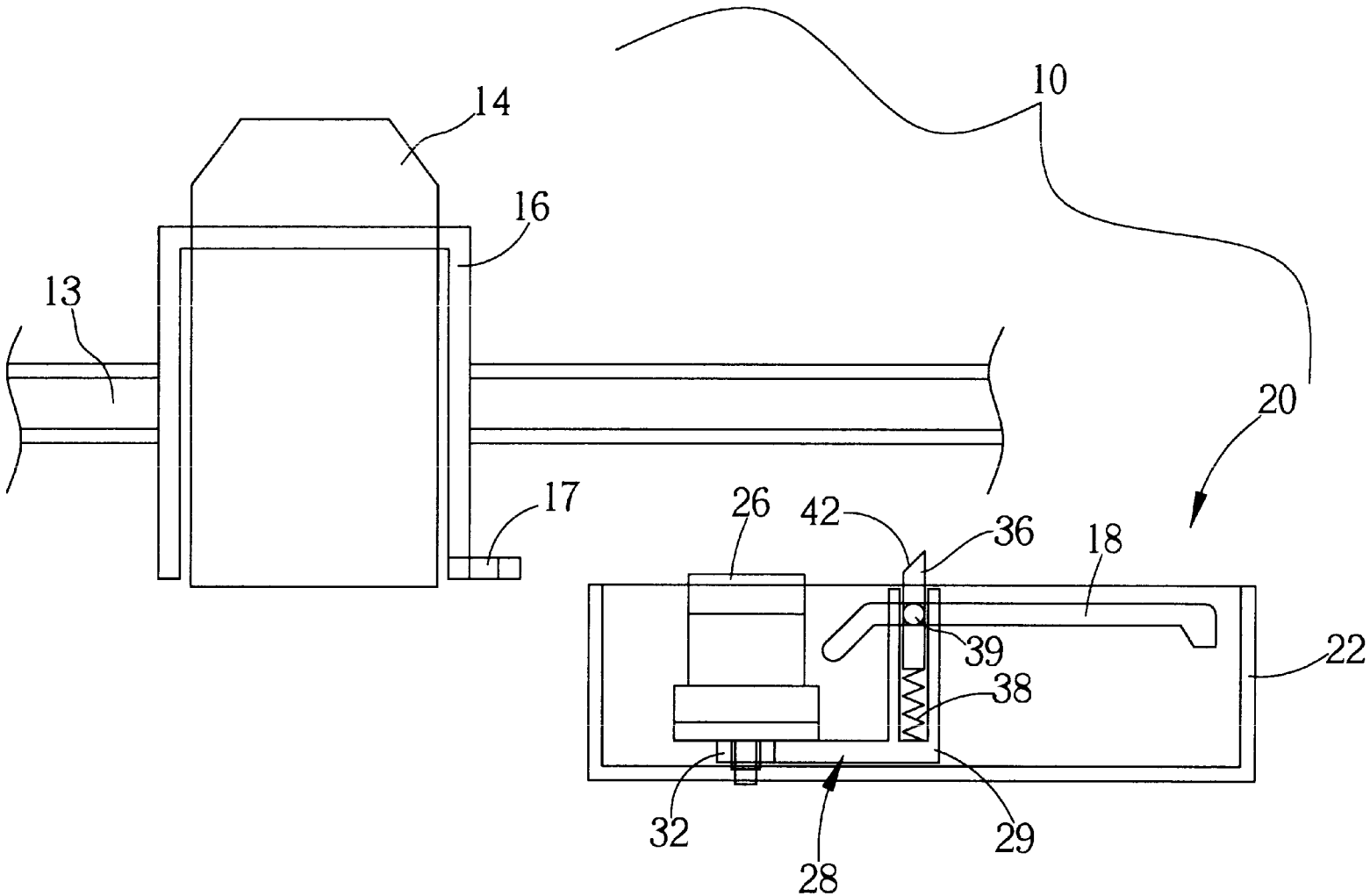

Please refer to FIG. 9 to FIG. 13. FIG. 9 to FIG. 13 are diagrams of continuous operations of relative movement between the print head 14 and the maintenance device 20. When the motor 12 drives the print head 14 to move to the maintenance device 20 along the direction of the horizontal track 13, the carrier 16 will ram against the guiding incline 42 of the plug 36 (as shown in FIG. 9), push the plug 36 to the end 40 of the first track 18, and bring the ink brush 36 to the second section of the second track 24 so that the plug 36 will insert into the receiving slot 17 at the bottom of the carrier 16 (as shown in FIG. 10). In this process, according to the plug 36 at the front side of the carrier 16, the ink brush 26 will be at a front side of the nozzle array 15, so the ink brush 26 will not contact with the nozzle array 15. After the plug 36 inserts into the receiving slot 17 of the carrier 16, the print head 14 can bring the connecting device 28 to move to the left and right sides on the first track 18 (as shown in FIG. 11). At this time the ink brush 26 is exactly below the nozzle array 15, so the ink brush 26 will wipe the nozzle array 15 back and forth along the first section of the second track 24 to clean remaining ink from the nozzle array 15. After that, the print head 14 will bring the plug 36 to the starting end 41 of the first track 18 and disengage with the plug 36 at the starting end 41 (as shown in FIG. 12, the relative positions of the carrier 16 and the plug 36 when disengaging). After the receiving slot 17 of the bottom of the carrier 16 disengages with the plug 36, it brings the plug 36 out of the starting end 41 of the first track 18 because of the pulling force of the spring 33, to restore the height of the guiding incline 42. For the next cycle, the bottom of the carrier 16 rams against the guiding incline 42 of the plug 36 again (as shown in FIG. 13).

Figure 14A:
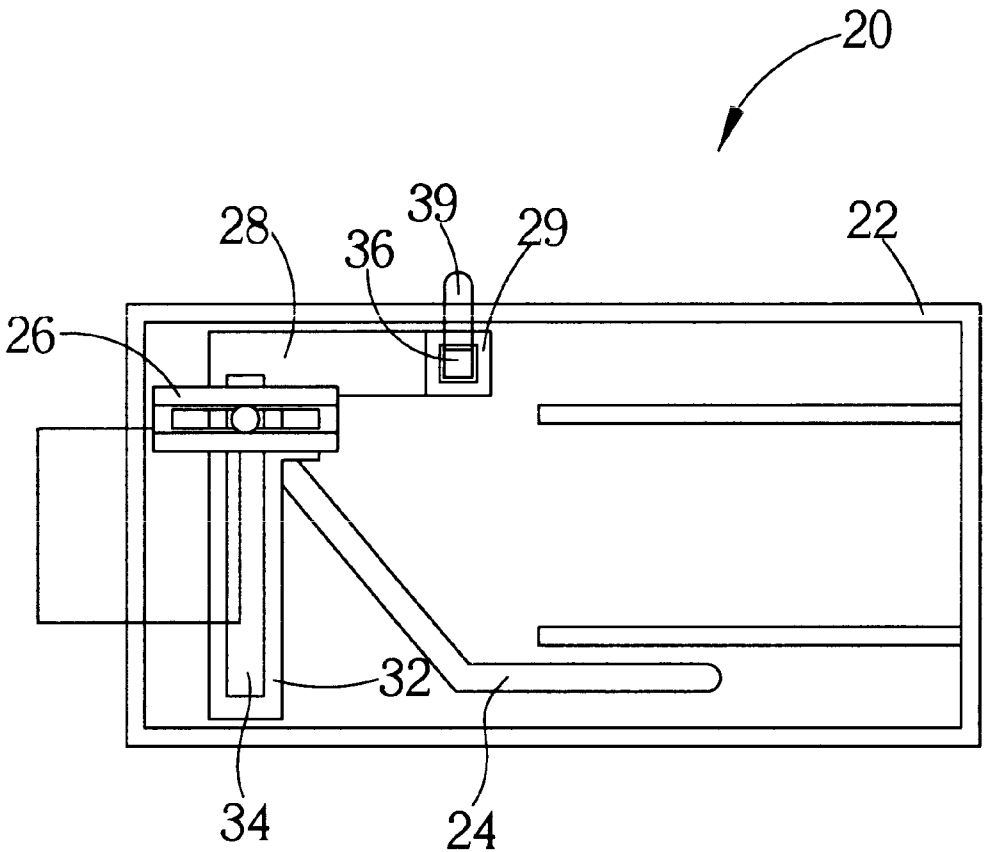
FIG. 14A to FIG. 17B are diagrams of decomposed operations of the maintenance device shown in FIG. 1.
Figure 14B:
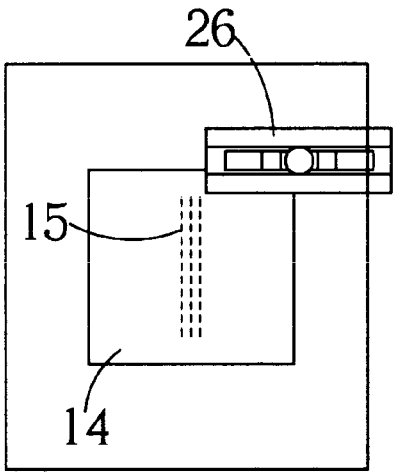
Figure 15A:
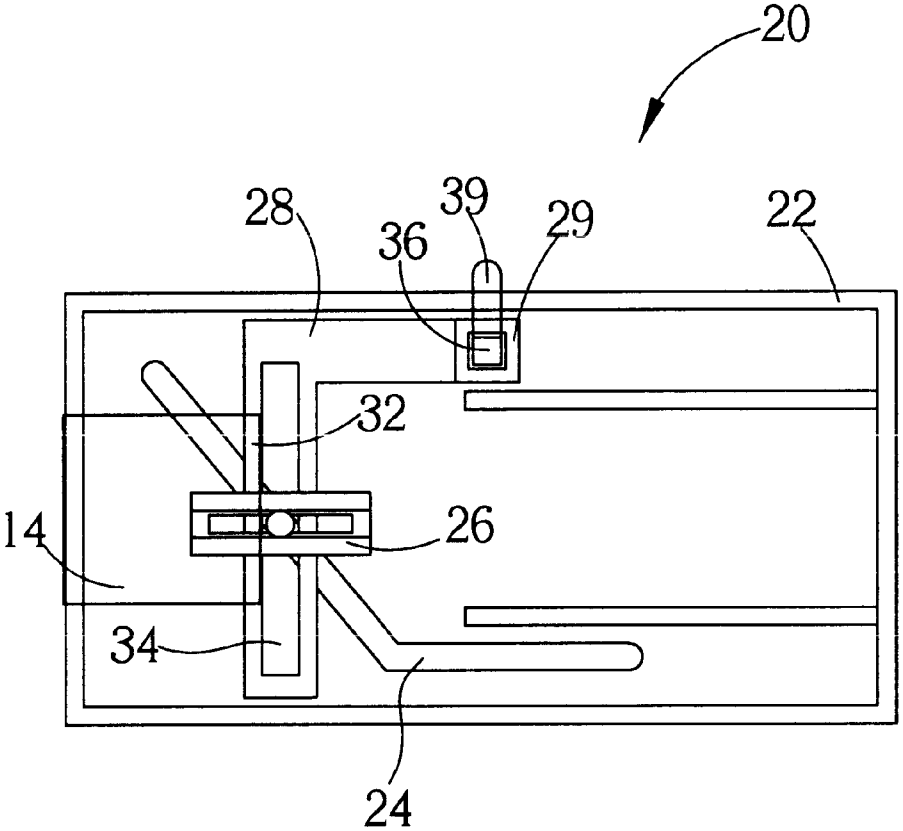
Figure 15B:
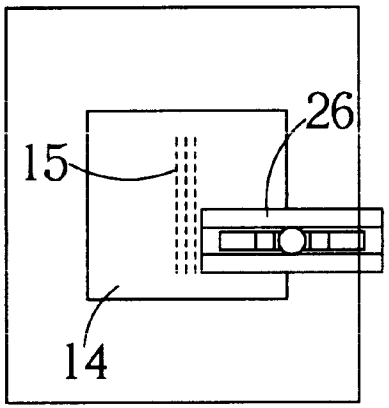
Figure 16B:
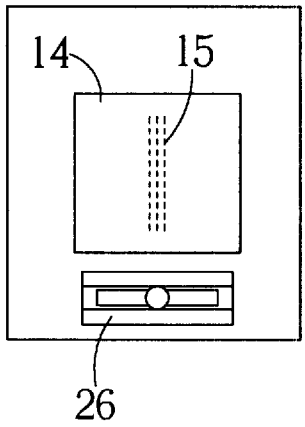
Figure 16A:
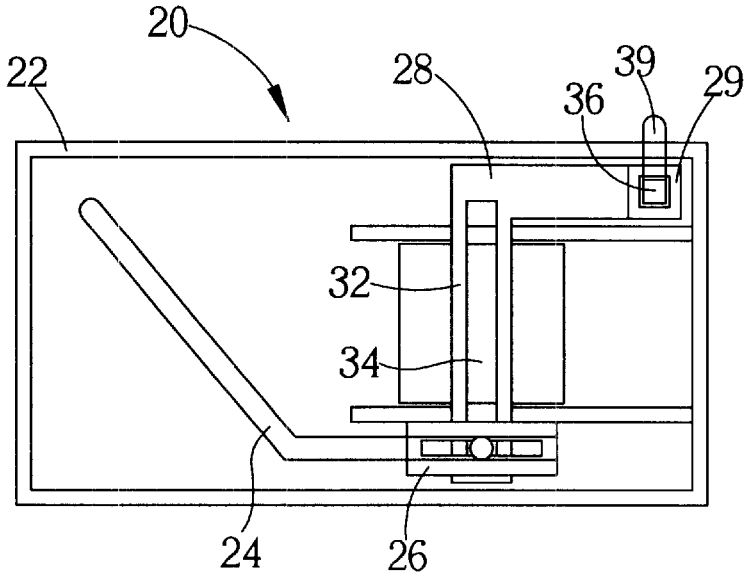
Figure 17B:
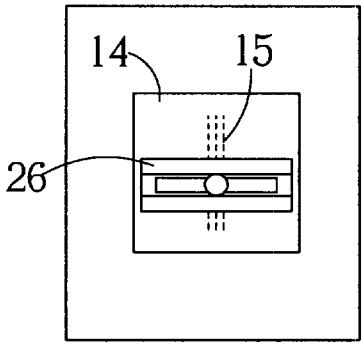
Figure 17A:
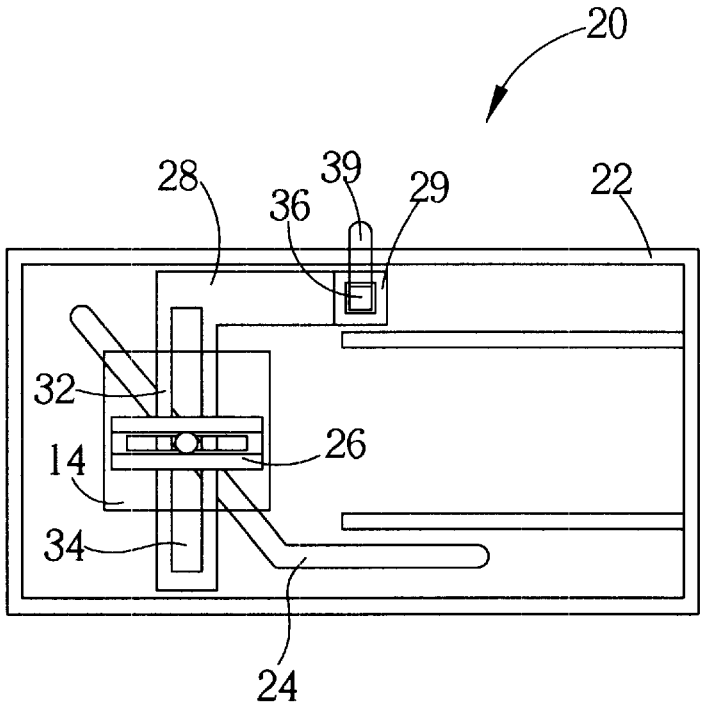

Please refer to FIG. 14A to FIG. 17B. FIG. 14A to FIG. 17B are diagrams of decomposed operations of the maintenance device 20. FIG. A is a top view, and FIG. B is a diagram of the relative positions of the print head 14 and the ink brush 26. The print head 14 has three arranged and parallel nozzle arrays 15 for spraying ink with three different colors. When the carrier 16 rams against the guiding incline 42 of the plug 36, according to the plug 36 at the front side of the carrier 16, the ink brush 26 will not contact the nozzle array 15, so the operation of cleaning remaining ink does not occur, as shown in FIGS. 14, 15A, and 15B. When the carrier 16 pushes the plug 36 to the end 40 of the first track 18 and makes the plug 36 insert into the receiving slot 17 of the carrier 16, the ink brush 26 will move to an alignment position with the nozzle arrays 15 (as shown in FIGS. 16A and B). When the ink brush 26 aligns to the nozzle arrays 15, the carrier 16 will bring the ink brush 26 into the first section of the second track 24 so that the ink brush 26 can move back and forth to clean the nozzle array 15 (as shown in FIGS. 17A and B).

The movement direction of the ink brush 26 of the present invention maintenance device 20 is perpendicular to the arrangement of the nozzle array of the print head 16. Therefore, it can effectively avoid chromatic ink contamination when the ink brush 26 wipes the print head 14. In the present invention, the power demand of the whole print head maintenance device 20 is identical to the power demand of the printing device 10 of the motor 12, so there is no need to add another motor to supply power to the print head maintenance device 20. When the plug 36 is inserted into the receiving slot 17 of the bottom of the carrier 16 at the end 40 of the first track 18, the ink brush 26 not only moves toward the direction of the first section of the second track 24 but also slides back and forth along the linear slot 34 of the driving end 32 of the connecting device 28. The ink brush 26, therefore, will wipe the surface of the print head 14 back and forth to clean remaining ink from the print head 14.

In the contrast to the prior art print head maintenance device, the cleaning method of the present invention print head maintenance device not only can co-operate more advanced print head device but also doesn't need another motor to supply power of another direction. Therefore, the present invention print head maintenance device can effectively extend the endurance of the print head and reduce the maintenance cost.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A print head maintenance device for cleaning a print head of a printing device, the print head being movable on a horizontal track of the printing device, the print head having at least one linearly arranged nozzle array, the maintenance device comprising:

a line-shaped first track in parallel with the horizontal track;

a line-shaped second track having a first section, the first section forming a slant angle with the first track;

an ink brush slidably installed on the second track for cleaning remaining ink on the nozzle array of the print head; and a connecting device moveable along the first track in the maintenance device;

wherein when the print head moves across the maintenance device, the print head will connect with the maintenance device through the connecting device, then the connecting device being capable of moving along the first track to slide the ink brush along the second track so as to clean remaining ink on the nozzle array of the print head.

2. The print head maintenance device of claim 1 wherein the second track further comprises a second section in parallel with the first track.

3. The print head maintenance device of claim 1 wherein the connecting device comprises a connecting end and a driving end, when the print head moves across the maintenance device, the print head will connect with the maintenance device using the connecting end of the connecting device, and the connecting device will move along the first track to slide the ink brush along the second track.

4. The print head maintenance device of claim 3 wherein the nozzle array is arranged in perpendicular with the horizontal track.

5. The print head maintenance device of claim 4 wherein the connecting device has a linear slot at the driving end arranged in parallel with the nozzle array, the ink brush having a bottom protruding through the linear slot and vertically installed on the second track in a slidable manner, wherein when the connecting device moves along the first track, the ink brush will move along the second track and along the linear slot at the driving end of the connecting device at the same time.

6. The print head maintenance device of claim 1 further comprising a housing, the second track being formed on a bottom side of the housing, the ink brush having a bottom vertically installed on the second track in a slidable manner, and the connecting device being installed inside the housing.

7. The print head maintenance device of claim 1 wherein the print head has a receiving slot, the connecting device having a plug for inserting into the receiving slot so as to connect the print head with the connecting device.

8. The print head maintenance device of claim 1 wherein the first track has a descended end and a starting end, when the connecting device moves to the descended end, the connecting device will connect with the print head, and then when the connecting device moves to the starting end, the connecting device will separate from the print head.

9. The print head maintenance device of claim 1 further comprising a motor for driving the print head back and forth along the horizontal track.

10. A printing device comprising:

a print head having at least one nozzle array; and a print head maintenance device, the print head performing relative motions with the maintenance device for cleaning the nozzle array of the print head;

characterized in:

that before cleaning the nozzle array, the maintenance device uses a coupling device comprising a plug and a receiving slot to couple with the print head so as to clean the nozzle array;

that during cleaning the nozzle array, an ink brush contacts and slides across the nozzle array to wipe ink from the nozzle array; and that after cleaning the nozzle array, the print head uses the coupling device to separate from the maintenance device.

11. A method of using a print head maintenance device of a printing device to clean a print head of the printing device comprising:

connecting the print head with the maintenance device; and driving an ink brush in the maintenance device along a direction forming a slant angle with a movement direction of the print head to allow the ink brush to clean a nozzle array of the print head in a perpendicular manner.

* * * * *

UNITED STATES PATENT AND TRADEMARK OFFICE

CERTIFICATE OF CORRECTION

PATENT NO. : 6,568,789 B2
DATED : May 27, 2003
INVENTOR(S) : Lin et al.

It is certified that error appears in the above-identified patent and that said Letters Patent is hereby corrected as shown below:

Title page,
Item [73], Assignee, change "Acer Communications and Multimedia, Inc." to -- Benq Corporation --.

Signed and Sealed this

Fourteenth Day of December, 2004

JON W. DUDAS
*Director of the United States Patent and Trademark Office*